US009719336B2

(12) United States Patent
Lynn

(10) Patent No.: US 9,719,336 B2
(45) Date of Patent: Aug. 1, 2017

(54) METHOD AND APPARATUS FOR ZONAL ISOLATION AND SELECTIVE TREATMENTS OF SUBTERRANEAN FORMATIONS

(71) Applicant: Saudi Arabian Oil Company, Dhahran (SA)

(72) Inventor: Jack D. Lynn, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 329 days.

(21) Appl. No.: 14/338,493

(22) Filed: Jul. 23, 2014

(65) Prior Publication Data

US 2016/0024899 A1 Jan. 28, 2016

(51) Int. Cl.

| | |
|---|---|
| ***E21B 21/08*** | (2006.01) |
| ***E21B 23/06*** | (2006.01) |
| ***E21B 33/124*** | (2006.01) |
| ***E21B 43/16*** | (2006.01) |
| ***E21B 23/04*** | (2006.01) |
| ***E21B 43/12*** | (2006.01) |
| ***E21B 43/25*** | (2006.01) |
| ***E21B 43/26*** | (2006.01) |
| ***E21B 43/267*** | (2006.01) |

(52) U.S. Cl.

CPC ..... *E21B 43/16* (2013.01); *E21B 23/04* (2013.01); *E21B 23/06* (2013.01); *E21B 33/1243* (2013.01); *E21B 43/128* (2013.01); *E21B 43/25* (2013.01); *E21B 43/255* (2013.01); *E21B 43/26* (2013.01); *E21B 43/267* (2013.01)

(58) Field of Classification Search

CPC ..... E21B 21/08; E21B 23/06; E21B 33/124; E21B 33/1243; E21B 33/1246; E21B 33/1275

USPC ..... 166/127

See application file for complete search history.

(56) References Cited

U.S. PATENT DOCUMENTS 3,417,827 A 12/1968 Smith et al.
4,236,113 A 11/1980 Wiley
(Continued)

FOREIGN PATENT DOCUMENTS

WO 0149973 A1 7/2001

OTHER PUBLICATIONS

PCT International Search Report and The Written Opinion of the International Searching Authority dated Oct. 2, 2015; International Application No. PCT/US2015/041728; International Filing Date: Jul. 23, 2015.

*Primary Examiner* — Cathleen Hutchins
(74) *Attorney, Agent, or Firm* — Bracewell LLP; Constance Gall Rhebergen

(57) ABSTRACT

A zonal isolation and treatment tool having a reversible fluid booster pump with a reversible motor, both an upper isolation and a lower isolation packer having an elastic surface, a treatment fluid distributor that provides selective fluid access and an electronics control package that couples to the reversible motor. The method includes introducing the tool into the well bore, inflating the upper and lower isolation packers using well bore fluid, introducing the treatment fluid into the well bore such that it is positioned proximate to the tool, operating the tool such that the treatment fluid is introduced into the isolated well bore volume, and maintaining the isolated well bore volume such that the targeted stratum forms a treated stratum.

21 Claims, 5 Drawing Sheets

(56) References Cited

U.S. PATENT DOCUMENTS

| | | | | |
|---|---|---|---|---|
| 4,535,843 | A | 8/1985 | Jageler | |
| 4,936,139 | A | 6/1990 | Zimmerman et al. | |
| 5,337,821 | A | 8/1994 | Peterson | |
| 5,549,159 | A | 8/1996 | Shwe et al. | |
| 6,427,530 | B1 | 8/2002 | Krueger et al. | |
| 6,622,554 | B2 | 9/2003 | Manke et al. | |
| 6,648,073 | B1 | 11/2003 | Jernigan et al. | |
| 6,834,727 | B2 | 12/2004 | Wills et al. | |
| 7,296,462 | B2 | 11/2007 | Gregory et al. | |
| 7,913,557 | B2 | 3/2011 | Vasques et al. | |
| 7,921,714 | B2 | 4/2011 | Duguid et al. | |
| 8,286,703 | B2 | 10/2012 | Clapp et al. | |
| 8,322,416 | B2 | 12/2012 | Pop et al. | |
| 2006/0248949 | A1* | 11/2006 | Gregory ..... | E21B 49/088 73/152.51 |
| 2009/0255669 | A1 | 10/2009 | Ayan et al. | |
| 2010/0319912 | A1 | 12/2010 | Pop et al. | |
| 2012/0018147 | A1 | 1/2012 | Niconoff | |

* cited by examiner

METHOD AND APPARATUS FOR ZONAL ISOLATION AND SELECTIVE TREATMENTS OF SUBTERRANEAN FORMATIONS

BACKGROUND OF THE INVENTION

1. Field of the Invention

The field of invention relates to a method and apparatus for treating a formation. More specifically, the field relates to a method and apparatus for isolating and selectively treating a hydrocarbon-bearing stratum.

2. Description of the Related Art

It is common in petroleum recovery to inject treatment chemicals into a well bore or into a subterranean formation in order to change its physical properties, including increasing permeability, removal of mineral or organic scales, reducing permeability to decrease water influx, and altering water production distribution along the length of the well bore.

An example of injecting a treatment chemical includes introducing an acidic fluid onto a well bore wall. The acidization treatment is performed to increase the permeability of the surrounding hydrocarbon-bearing stratum and facilitate the flow of hydrocarbons into the well from the face of the formation. In matrix acidizing, the acid-bearing fluid passes into the formation at a pressure less than the fracturing pressure of the hydrocarbon-bearing stratum. Increased permeability is obtained through chemical reaction between the acidic fluid and the hydrocarbon-bearing stratum, not by "fracking" the hydrocarbon-bearing stratum through over pressurization of the introduced fluid.

Another example of injecting a treatment chemical includes "acid fracking" of a carbonate formation. Acidic fluids are introduced into the well bore at pressures and fluid velocities sufficient to exceed the fracture gradient of the treated stratum. The effect is to physically fracture the rock within the hydrocarbon-bearing stratum while also chemically etching the exposed faces along the new fracture lines. The combination of fracking and acid etching forms new flow channels in the formation for either hydrocarbon-bearing fluid production or additional treatment injections.

As previously suggested, both matrix and fracture acid injection are only two of several ways to enhance, control and modify the productivity or injectivity, or both, of a formation. Other chemical treatments include well-bore clean-up, drilling damage removal, water conformance and shut-off, relative permeability modifiers (RPM) fluids, proppant fracking, jetting, mineral and organic scale mitigation and removal, and chemical, scale and corrosion control squeezes.

An important factor in ensuring the efficacy of any chemical treatment is the chemical's delivery to the treatment site. The treatment chemical should be introduced preferably in a manner that focuses the treatment chemical only into the area or onto the surface to be treated. This helps ensure that the chemical treatment is at its maximum efficacy upon application.

Application of such chemical treatments currently occur by deploying a tool into a well bore using a coiled tubing unit (CTU) or other tubing conveyed platforms such as a conventional or workover rig. Such a deployment means has several limitations. Such units, even CTUs, are expensive to rent by the hour, and sometimes there are long wait times for availability and transportation issues for remote locations inland. This results in delayed flow-back from the well of production fluid that can be processed by surface units. After placement of the tool by the CTU or rig, a high-pressure surface pump is required to pressurize the treatment chemical for introduction into the tool through the CTU. After applying the treatment chemical at the site, there is usually no means for removing the spent chemical treatment fluid from the application site. "Reversing" the flow path of high-pressure surface pumps requires engineering and construction support not typically found on location, where typically the rigs or units are simply dropped off and erected. Tubing units may not have the proper materials of construction to permit both the application of the treatment chemical and then exposure to the spent treatment chemical by reversing flow. "Lifting" the spent treatment fluid as well as potentially production fluids from the treatment site may resulting in the spent treatment fluid containing rock, sand and other particulates, spent treatment chemical, water, brines and hydrocarbon-bearing fluids from the treated stratum. If any gas is present in the production fluid, its rapid depressurization under surface pumping may cause a loss of well bore control. Finally, the tool must be extracted from the well bore, the well bore fluid balanced for production testing to prevent flow back and the treatment's effectiveness determined through direct or indirect detection means. If the treatment was unsuccessful, all of the equipment for treatment application needs to be reinstalled again.

If a coiled tubing unit is not used to deliver the treatment chemicals to the well bore site, treatment of the targeted stratum may become less expensive but more technically difficult as only differences in fluid properties are used to target the treatment site and preventing the remainder of the well bore from inadvertent treatment. Without a CTU or other fluid delivery means downhole at the treatment site, the chemical treatment must be "bullheaded" (that is, pumped down the producing string or casing) to the targeted stratum. Diversion fluids are often used to route the treatment chemical to the treatment site using physical (for example, density) or chemical (for example, aqueous vs. hydrocarbon incompatibility) differences between the fluids. The placement of diverting fluids is property and condition dependent—minor changes in composition, such as salinity or water content, or temperature, can cause diverting fluids to mix or blend unexpectedly, to be absorbed into the formation, to invert and change positions within the well bore, to react prematurely or to not react at all.

If diversion fluids are not used, the treatment chemical can be introduced from the surface and mixed with the entirety of the well bore fluid using low pressure well bore fluid circulation pumps. These low pressure circulation pumps are standard equipment on rigs that drill into formations and form well bores. However, this is not a desirable option if the treatment chemical is active on other constituents within the well bore or with constituents of the well bore fluid, including casing, exposed well bore walls, equipment and prior treatments sites. Bullheading such a treatment chemical often requires a greater volume of chemicals as the efficacy of the treatment chemical is diluted due to blending, fluid friction, emulsification, reaction with other chemicals, mixing with the well bore fluid.

It is desirable to find an isolation and application apparatus and a method of using the apparatus to apply a treatment chemical to the targeted formation without the need for using coiled tubing or specialized workover units. It is also desirable to be able to easily convey the treatment chemical to the targeted stratum using lower pressure surface pumps while maintaining a high treatment chemical efficacy. It is also desirable to be able to remove the treatment chemical from the application site to evaluate the treatment's efficiency as well as to performance test the treated stratum before removing the isolation and application apparatus.

SUMMARY OF THE INVENTION

A method of using a zonal isolation and treatment tool for introducing a treatment fluid to a targeted stratum within a formation such that the targeted stratum is converted to a treated stratum includes the step of introducing the tool into a well bore such that the targeted stratum is positioned between an upper isolation packer and a lower isolation packer of the tool. The well bore is defined by a well bore wall. The well bore traverses the formation from a surface downwards to at least the targeted stratum. The well bore is filled with a well bore fluid. Both the upper and lower isolation packers are each operable to fluidly seal against the well bore wall upon inflation.

The method includes the step of operating the tool such that a reversible fluid booster pump of the tool draws the well bore fluid into the tool. In addition, the step includes that each of the upper and lower isolation packers are inflated with the well bore fluid such that both the upper and lower isolation packer seal fluidly against the well bore wall. The upper isolation packer seals uphole of the targeted stratum and the lower isolation packer seals downhole of the targeted stratum. An isolated well bore volume forms between the upper isolation packer and the lower isolation packer. The isolated well bore volume is selectively fluidly accessible to the remainder of the well bore through a treatment fluid distributor of the tool. At least a portion of the well bore wall associated with the targeted stratum is located between the upper and lower isolation packers. The portion of the well bore wall associated with the targeted stratum is operable to provide fluid communication between the isolated well bore volume and the targeted stratum. The tool includes the reversible fluid booster pump that is operable to draw the well bore fluid into the tool through a pump fluid access port. The tool also includes the treatment fluid distributor that is operable to provide selective fluid access between the isolated well bore volume and the remainder of the well bore.

The method includes the step of introducing a treatment fluid into the well bore such that the treatment fluid is positioned proximate to the pump fluid access port of the tool.

The method includes the step of operating the tool such that the reversible fluid booster pump draws the treatment fluid into the tool from the well bore through the pump fluid access port and that the treatment fluid distributor discharges the treatment fluid from the tool through treatment fluid port into the isolated well bore volume.

The method includes the step of maintaining the isolated well bore volume such that the treatment fluid interacts with the targeted stratum through the at least a portion of the well bore wall associated with the targeted stratum. The treatment fluid forms a spent treatment fluid and the targeted stratum forms the treated stratum upon interaction with one other.

A zonal isolation and treatment tool includes the reversible fluid booster pump having the reversible motor mechanically coupled to the booster pump. The reversible fluid booster pump has the pump fluid access port that is operable to provide selective fluid access through the booster pump. The booster pump is coupled to the internal fluid conduit located within the tool. The tool includes both the upper isolation packer and the lower isolation packer, each having an elastic surface that is operable to fluidly seal against another surface when inflated. Both the upper isolation packer and the lower isolation packer are selectively fluidly coupled through the internal fluid conduit with the booster pump. The tool includes the treatment fluid distributor that is located upstring of the lower isolation packer and downstring of the upper isolation packer. The treatment fluid distributor has the treatment fluid port that is operable to provide selective fluid access to the internal fluid conduit. The treatment fluid distributor is selectively fluidly coupled through the internal fluid conduit with the booster pump. The tool includes the electronics control package (ECP) that is electrically coupled to the reversible motor. The tool is operable to maintain selectively both spin direction and spin rate of the reversible motor of the reversible fluid booster pump.

The zonal isolation and treatment tool is operable to isolate and permit selective operations on the stratum to be treated and the treated stratum. Selective operations include application of a treatment chemical to the portion of the stratum to be treated, removal of a spent treatment chemical from the treated stratum, and production of a production fluid from the treated stratum without affecting the remainder of the well bore or non-treated portions of the formation. The tool is useful for introducing a treatment fluid to a targeted stratum and otherwise fluidly isolated portion of the formation.

Previously, only tubing conveyed systems were operable to isolate and treat a specific interval of targeted stratum; however, such systems required high-pressure surface fluid pumps to move the treatment chemical downhole and were unable to provide either evacuation of the spent treatment chemical or lifting of the production fluid following successful intervention. The zonal isolation and treatment tool accomplishments all these functions and more.

The zonal isolation and treatment tool provides several benefits over prior-art tubing conveyed systems. The tool can be deployed by wireline, coiled tubing or tractor drive depending on the configuration of the well bore (that is, vertical, deviated and horizontal). There is no requirement for coiled tubing unit (CTU), standard drilling or workover rigs for stimulation or intervention. Signals associated with controlling the tool, detected conditions within and outside of the isolated portion of the well bore, the production performance of the targeted or treated stratum and operation of the tool, can be conveyed using wireline, e-line or wireless means in embodiments of the tool. Since the tool includes a reversible, high pressure, high volume downhole fluid booster pump, only low-pressure fluid circulation surface pumps are needed to circulate the treatment chemical downhole and circulate the spent treatment chemical and production fluid uphole.

Diverting fluids are not required for treating the targeted stratum using the tool. The tool allows for precise application of treatment chemicals, which means that smaller volumes of treatment chemicals can be used. This prevents using larger volumes of treatment chemicals to account for blending down or other reasons for reduced efficacy. The use of a physical tool that isolates a portion of the well bore allows for accurate positioning, isolation of the portion of the stratum to be treated, and application of appropriate pressure, volume and flow rate of treatment chemical into the stratum to be treated. Diverting fluids cannot offer such precision due to changing well bore conditions and fluid properties.

The tool can be left in place for a variety of activities both pre- and post-treatment. Leaving the tool in place can allow for shut-in of the formation. Immediate shut-in allows for immediate well bore control, including the cessation of treatment, the isolation of the treatment volume during a period of treatment, or the suppression of an upset or unexpected yet detectable well bore condition. Relying on diversion fluids or an application tool that does not isolate the treatment site does not permit such well bore control at the application site.

The tool is operable to permit rapid in-situ evaluation of the effectiveness of the chemical treatment and the condition of the treated stratum while the treatment site is isolated and prior to tool relocation or extraction. An embodiment of the tool is operable to detect conditions within and external to the isolated portion of the well bore using sensors and the electronics control package. Such detected conditions can provide the necessary information to determine whether the treatment is complete, whether the application of treatment chemical was successful or did not achieve the desired result, the current condition of the isolated volume of well bore, and whether the treated stratum is ready to initiate production. Not achieving the desired result with the first application of treatment chemical while the tool is still in position providing the opportunity for the immediate reintroduction of a fresh amount of the same treatment chemical or another treatment chemical to the same treatment site.

Reversal of the fluid flow direction of reversible fluid booster pump from introduction to evacuation can clear the isolated portion of the well bore of spent treatment chemical and draw in to the well bore production fluid from the treated stratum for analysis. Pumping out the isolated well bore volume after treatment and reducing fluid pressure within the volume can provide data regarding the success or failure of the chemical treatment. For example, pumping out the chemical treatment and permitting some production fluid to enter the isolated well bore volume permits the tool to detect the amount of water in the production fluid for water conformance and water shut-off treatment effectiveness. Pumping out the volume can also act as a metric for measuring the effectiveness of stimulation, scale removal or etching treatment such as by measuring an improvement in production rate.

Reversal of the fluid flow direction of reversible fluid booster pump from introduction to evacuation can assist in kicking off hydrocarbon production. Pumping from the isolated volume by the reversible fluid booster pump forms a localized yet restricted volume in the well bore where the well bore is underbalanced. Production fluid from the treated stratum is drawn into the isolated well bore volume as the formation attempts to equilibrate the pressure of the treated stratum with the underbalanced isolated well bore volume in which it is in fluid contact. With continuous pumping, an embodiment of the tool can operate as a submersible lifting device, where production fluid is continually drawn from the isolated portion of the well bore and directed uphole at a higher fluid pressure than the pressure at which it was produced for production through the reversible fluid booster pump of the tool. By maintaining isolation of the producing portion of the well bore using the tool, the remainder of the well bore can be maintained, including putting the non-isolated portions of the well bore into under or overbalanced conditions.

After treatment operations are complete at a first targeted stratum, the tool can be operated such that it de-isolates the isolated well bore volume and allows the first treated stratum to be exposed to the remainder of the well bore. Upon reintroduction of the contents of the well bore to the first treated stratum, the treatment is complete. The tool can either then be extracted from the well bore using commonly understood techniques, or the tool can be positioned within the well bore at a second targeted stratum. The second targeted stratum and the first targeted stratum can be portions of the same stratum within the same formation (for example, a very thick hydrocarbon producing layer) or a completely unrelated stratum (for example, a hydrocarbon-bearing formation and a brine-bearing layer).

The tool is operable to support multi-chemical treatment or multi-location treatment without extraction from the well between treatments or before the next treatment. This is especially useful for horizontal wells with a long horizontal leg (+1 mile) extending from a deviated or vertical portion of the well bore, multi-lateral well bores, and multi-tiered well bores, where introduction into, movement around and extraction from the well each are timely and costly operations.

The zonal isolation and treatment tool is useful for vertical, deviated, and horizontal wells where there is no continuous need for rotational operations.

Embodiments of the zonal isolation and treatment tool are operable to distribute a variety of treatment fluids downhole in fluid contact within the isolated portion of the well bore. Useful treatment fluids include matrix acidizing fluids, acid or pressure fracking fluids, acidic wellbore treatment fluids, fluids with proppants, polymer water shut-off fluids, chemical diversion fluids and gels, fluids (di- or tri-phase fluids) for enhanced oil recovery, foams, surfactant solutions, mud and scale removal treatment fluids, relativity permeability modifiers (RPM) fluids, and water conformance fluids.

BRIEF DESCRIPTION OF THE DRAWINGS

These and other features, aspects, and advantages of the present invention are better understood with regard to the following Detailed Description of the Preferred Embodiments, appended Claims, and accompanying Figures, where:

In the accompanying Figures, similar components or features, or both, may have the same or similar reference label. FIG. 1 and FIGS. 2A-2G are general schematics of several embodiments of the zonal isolation and treatment tool and their method of use. The Figures and their description facilitate a better understanding of the tool and its method of use. In no way should the Figures limit or define the scope of the invention.

DESCRIPTION OF THE PREFERRED EMBODIMENTS

Figure 1:
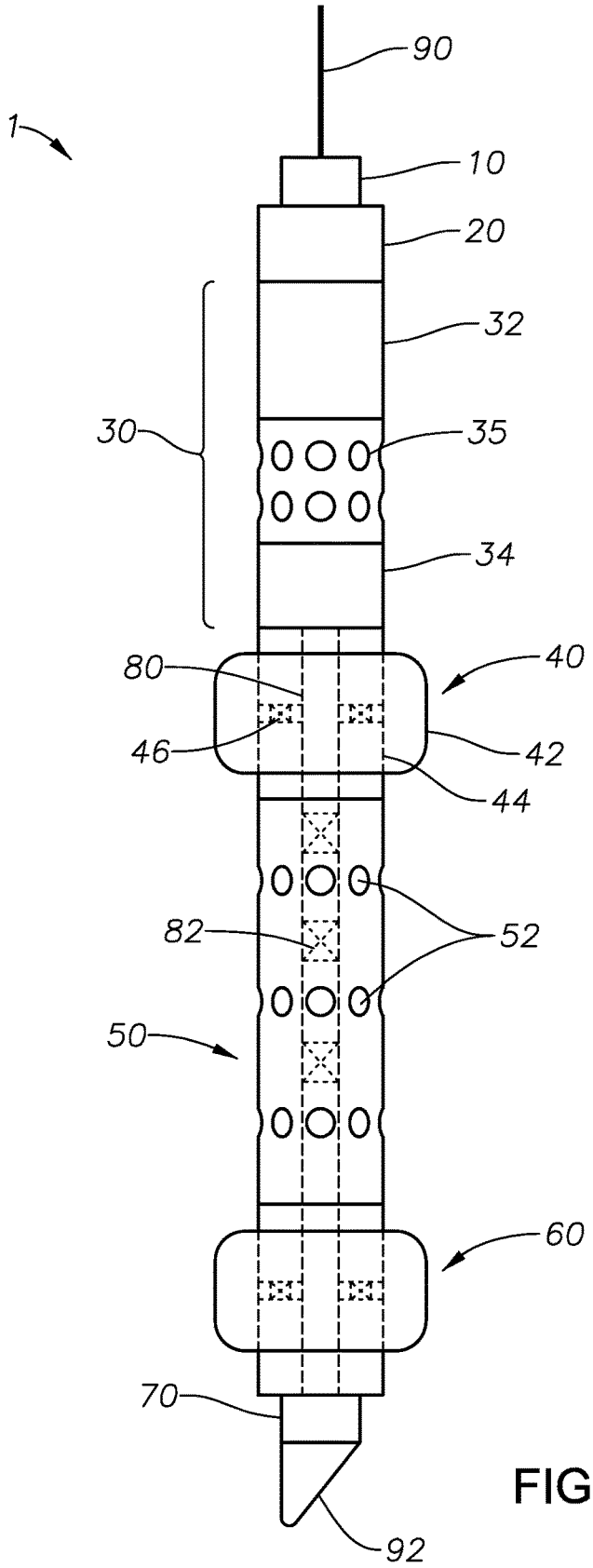
FIG. 1 is a schematic of an embodiment of the zonal isolation and treatment tool.

The Specification, which includes the Summary of Invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification. Those of skill in the art understand that the invention is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the invention. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Optionally" and its various forms means that the subsequently described event or circumstance may or may not occur. The description includes instances where the event or circumstance occurs and instances where it does not occur. "Operable" and its various forms means fit for its proper functioning and able to be used for its intended use. "Associated" and its various forms means something connected with something else because they occur together or that one produces the other.

Spatial terms describe the relative position of an object or a group of objects relative to another object or group of objects. The spatial relationships apply along vertical and horizontal axes. Orientation and relational words, including "up", "down", "higher", "lower", "upstring", "downstring", "uphole", "downhole" and other like terms, are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The invention encompasses and bounds smaller ranges of the interval subject to any specific exclusion provided.

Where the Specification and appended Claims reference a method comprising two or more defined steps, the defined steps can be carried out in any order or simultaneously except where the context excludes that possibility.

FIG. 1

An embodiment of a zonal isolation and treatment tool as shown in FIG. 1 (tool 1) includes upper connector 10, electronics control package (ECP) 20, reversible fluid booster pump 30, upper hydraulically activated packer 40, treatment fluid distributor 50, lower hydraulically activated packer 60 and lower connector 70, each mechanically coupled in series upstring to downstring as part of tool 1. Tool internal fluid conduit 80 runs at least a portion of the length of tool 1, is formed by segments of and fluidly couples downhole reversible booster pump 30, upper hydraulically activated packer 40, treatment fluid distributor 50 and lower hydraulically activated packer 60 such that a fluid may flow between and through portions of tool 1.

As shown in FIG. 1, the zonal isolation and treatment tool is operable to be deployed within a vertical or deviated well bore using the upper connector. Tool 1 includes upper connector 10, which is operable to couple with wireline 90. Wireline 90 is useful for introducing, positioning and supporting tool 1 into and while in the well bore. Wireline 90 is operable to convey electrical power from an electrical power surface source (not shown) to electronics control package 20 and downhole reversible booster pump 30. Wireline 90 is operable to convey a signal between electronics control package 20 and a surface signal source/receiver (not shown). An embodiment of the tool has an upper connector that is operable to couple with coiled tubing from a coiled tubing unit (CTU) for introducing, positioning and supporting into and while in the well bore.

The zonal isolation and treatment tool is also operable to be deployed within a vertical, deviated or horizontal well bore using the lower connector. Tool 1 has lower connector 70 coupling to mule toe 92. An embodiment of the tool has the lower connector that is operable to couple with an electrically or hydraulically-powered towing or tractor mechanism for pulling the tool downhole from the surface and positioning it within the well bore.

The zonal isolation and treatment tool includes at least one upper hydraulically activated packer and at least one lower hydraulically activated packer. Also known as "isolation packers" or "straddle packers", tool 1 has upper hydraulically activated packer 40 upstring of lower hydraulically activated packer 60. Each hydraulically activated packer 40, 60 has elastic surface 42 that expands and contracts based upon the introduction (inflation) and removal (deflation) of well bore fluid from its interior.

The zonal isolation and treatment tool is operable to isolate a volume of the well bore or targeted stratum from the remainder of the well bore using the isolation packers. The chemical treatment can be administered into the isolated portion of the well bore volume. Isolation is achieved when the hydraulically activated packers are inflated such that the elastic outer surface presses against the well bore wall surface ("seating the packer") such that a fluid cannot pass between the well bore wall and the elastic packer surface. This seal at each packer produces the fluid isolation between the isolated portion of the well bore and the remainder of the well bore. Each hydraulically activated packer 40, 60 is operable to be inflated by the introduction of well bore fluid through tool internal fluid conduit 80 and to be deflated by passing the contained well bore fluid through tool internal fluid conduit 80. Fluid for inflating and deflating each hydraulically activated packer passes through packer fluid conduit 44 into or from the void space formed by elastic surface 42. Packer isolation valve 46 provides selective access to the expandable portion of each hydraulically activated packer 40, 60. Access is permitted when a packer is inflating or deflating and denied when the packer is isolated and maintained in its inflated or deflated state. Each hydraulically activated packer has multiple packer fluid conduits and packer isolation valves to expedite inflation and deflation operations.

An embodiment of the zonal isolation and treatment tool includes more than one of each type of hydraulically activated packer. Multiple upper and lower hydraulically activated packers, including double-sets of upper and lower packers, provides additional assurance that there is no fluid conveyed between the portions of the well bore uphole and downhole from each set of packers (the remainder of the well bore) and the isolated well bore volume except as selectively permitted by the tool.

The zonal isolation and treatment tool includes a reversible, variable speed, high volume, high pressure downhole fluid booster pump. The reversible fluid booster pump is positioned upstring of the upper hydraulically activated packer such that the downhole reversible booster pump is operable to convey fluid between the isolated well bore volume between inflated upper and lower hydraulically activated packers and the remainder of the well bore volume uphole of the upper hydraulically activated packer. Because the motor spin direction is reversible, the reversible fluid booster pump is operable to both convey fluids into the fluidly isolated well bore volume and to convey fluids from the fluidly isolated well bore volume by rotating the motor in one direction or the other.

As shown in FIG. 1, reversible fluid booster pump 30 includes reversible motor 32, which couples to and drives the direction of fluid flow though booster fluid pump 34. Pump fluid access port 35 permit fluids to pass into or from tool 1 uphole of upper inflatable packer 40. Whether fluid is being drawn into or passed from tool 1 through pump fluid access port 35 depends on the rotation of reversible motor 32.

The zonal isolation and treatment tool includes a tool internal fluid conduit that runs internally along at least a portion of the length of the tool. As shown in FIG. 1, portions of upper hydraulically activated packer 40, treatment fluid distributor 50 and lower hydraulically activated packer 60 combine to form tool internal fluid conduit 80. The upper hydraulically activated packer, the treatment fluid distributor and the lower hydraulically activated packer each comprise a portion of the tool internal fluid conduit. When components of the tool that comprise a segment of the tool internal fluid conduit physically couple together, the tool internal fluid conduit forms between the coupled components. Optionally, the electronics control package has an internal fluid conduit segment. Optionally, the lower connector has an internal fluid conduit segment.

The reversible fluid booster pump is positioned such that the booster fluid pump is operable to pass fluid into and draw fluid from the tool internal fluid conduit. In such a manner, fluids are drawn into, conveyed through and passed from the tool into either the remainder of the well bore uphole from the tool or into the isolated well bore volume, depending on the fluid flow direction. FIG. 1 shows booster fluid pump 34 physically connected to upper hydraulically activated packer 40 such that booster fluid pump 34 fluidly couples to the upstring portion of tool internal fluid conduit 80.

An embodiment of the zonal isolation and treatment tool includes the lower connector having an internal fluid conduit segment that is operable to form part of the tool internal fluid conduit. Such an embodiment permits the coupling of a hydraulically-driven towing or tractor mechanism as the leading component or on the downstring portion of the tool instead of a mule toe or other non-active well bore guide. Such an embodiment is operable to be hydraulically-motivated by drawing fluid into the tool through the pump fluid access port, discharging pressurized fluid from the booster fluid pump, passing the pressurized fluid through the tool internal fluid conduit and discharging the pressurized fluid through the coupled hydraulic-motivated tractor, where the tractor converts the energy of the discharging pressurized fluid into mechanical movement for moving the tool through the well bore.

The reversible fluid booster pump is operable to pump fluid at a volume rate in a range of from about 10 gallons to about 100 gallons per minute as measured at standard conditions. The fluids being pumped by the reversible fluid booster pump include treatment chemical, spent treatment chemical, production fluid, water, brines and combinations thereof. In an embodiment of the tool, the reversible fluid booster pump is operable to pressurize the fluid introduced into the isolated well bore volume such that the pressure of the fluid within the isolated well bore volume is maintained at a pressure less than or equal to about the pore pressure of the stratum to be treated. In an embodiment of the tool, the reversible fluid booster pump is operable to pressurize the fluid introduced into the isolated well bore volume such that the pressure of the fluid within the isolated well bore volume is maintained as a pressure greater than about the pore pressure of but less than about the fracture pressure of the stratum to be treated. In an embodiment of the tool, the reversible fluid booster pump is operable to pressurize the fluid introduced into the isolated well bore volume such that the pressure of the fluid within the isolated well bore volume is maintained as a pressure equal to or greater than about the fracture pressure of the stratum to be treated.

The "pore pressure" is the pressure of a fluid within the pores of the stratum to be treated. When impermeable rocks are compacted, the fluid present in the pores cannot escape and must support the total overlying rock column, leading to a fluid pore pressure that reflects the pressure exerted by the weight of the stratum and overburden on the fluid. Pore pressure reflects the fluid pressure in the stratum at the time of treatment. The "fracture pressure" is the pressure greater than which the injection of a fluid will cause the stratum being treated to fracture hydraulically.

The zonal isolation and treatment tool includes a treatment fluid distributor that is located between the upper isolation packer and the lower isolation packer such that when the packers are inflated and the isolated well bore volume forms the treatment fluid distributor is within the isolated well bore volume. In FIG. 1, treatment fluid distributor 50 has several treatment fluid port 52. Treatment fluid port 52 couple with tool internal fluid conduit 80 such that fluids can selectively pass to and from tool internal fluid conduit 80. FIG. 1 does not show isolation valves or fluid conduits coupling treatment fluid port 52 and tool internal fluid conduit 80 for the sake of clarity. Such isolation valves are similar in operation to packer isolation valve 46, and such fluid conduits are similar in operation to packer fluid conduit 44. The treatment fluid distributor is operable to introduce treatment chemicals and fluids passing into the isolated well bore volume. The treatment fluid distributor is also operable to receive fluids from the isolated well bore volume. Such received fluids are drawn into the tool through the action of the reversible fluid booster pump.

FIG. 1 shows treatment fluid port 52 as similar to open port on the treatment fluid distributor. An embodiment of tool includes fluid port that are specialized for distributing fluid in a discrete manner, including nozzles, spargers, jetting port, distribution arrays and fracture jetting tools. The fluid port can be modified for the particular job that the tool is performing. If sufficient pressure is applied to the fluid being distributed into the isolated well bore volume, an embodiment of the tool is operable to distribute the introduced fluid into the isolated well bore volume such that the introduced fluid forms a discrete fluid jet. The discrete fluid jet is of such velocity that minimal mixing occurs with the fluid within the isolated well bore volume. The discrete fluid jet contacts the well bore wall of the stratum to be treated such that most of the treatment chemical or introduced fluid is not diluted as compared to the fluid drawn into the tool at the reversible fluid booster pump.

FIG. 1 also shows an embodiment of the zonal isolation and treatment tool that has internal fluid conduit isolation valves 82 as part of treatment fluid distributor 50. Such isolation value may also be located in other tool components, for example, the upper and lower isolation packers, the reversible fluid booster pump and the lower connector.

An internal fluid conduit isolation valve is operable to selectively permit fluid flow through the internal fluid conduit regardless of fluid flow direction.

The electronics control package (ECP) of the tool is coupled electrically with the reversible motor of the reversible fluid booster pump. In FIG. 1, ECP 20 physically and electrically couples to reversible motor 32 of reversible fluid booster pump 30 such that the flow rate and direction of the fluid through tool 1 can be selectively directed. Although not specifically shown, ECP 20 couples to packer isolation valves 46 such that fluid flow can be selectively directed to and from isolation packers 40, 60. ECP 20 also couples to isolation valves associated with treatment fluid port 52 of treatment fluid distributor 50 such that the fluid can be selectively directed through the treatment fluid port 52. ECP 20 also couples to internal fluid conduit isolation valves 82 such that the fluid is selectively permitted to flow through treatment fluid distributor 50 and between treatment fluid distributor 50, lower hydraulically activated packer 60, lower connector 70 and reversible fluid booster pump 30.

The electronics control package of the zonal isolation and treatment tool is operable to couple with a source of power, including through a wireline or with an on-board battery pack, to draw power and selectively distribute electrical power through the tool using electrical couplings. In an embodiment of the tool, the ECP is operable to selectively distribute electrical power to the booster fluid pump in a manner such that the reversible motor spin rate and the direction of the spin is maintained. The rate and spin direction of the reversible motor dictates the fluid pumping rate and the flow direction through the tool internal fluid conduit. In an embodiment of the tool, the ECP is operable to distribute selectively electrical power to the isolation valves within the tool such that the valves positions change from "open" to "closed", or vice versa, depending on their no-power setting. The position of sets of isolation values and the direction of fluid flowing through the tool while the reversible fluid booster pump is operating support tool-related operations, including inflation and deflation of the inflatable packers, introducing fluid into or removing fluid from the isolated well bore volume and directing fluid towards an attached hydraulically-driven towing or tractor mechanism. In an embodiment of the tool, the ECP is operable to selectively distribute electrical power directly to an electrically-driven towing or tractor mechanism.

In an embodiment of the zonal isolation and treatment tool, the ECP of the tool is operable to receive a signal associated with a detected well bore condition within the well bore or as part of the operational condition of the tool. In such an embodiment, the tool includes at least one sensor that is operable to provide a signal associated with the detected condition. Upon detecting the condition, the sensor generates the associated signal and conveys the signal to the ECP. The sensor can detect the condition, generate and convey the associated signals continually, periodically or upon demand through a signaling means to indicate a period for detecting the condition.

Optionally, the tool has a sensor for detecting a wellbore condition. An embodiment of the tool includes a conductivity sensor on the exterior of the treatment fluid distributor such that the conductivity of the fluid within the isolated well bore volume is detectable. Salinity or mineral concentration of the fluid within isolated well bore volume can be determined using the associated signal conveyed from the conductivity sensor upon detecting the wellbore condition. Other sensors are useful for detecting wellbore conditions, including fluid flow rate, fluid pressure, fluid temperature, gas content, pH, density, viscosity, fluorescence, radioactivity, solids content, clarity, composition, and compressibility of the well bore fluid; actual bore hole size and shape, inclination, azimuth, depth, resistivity/conductivity, porosity, wall temperature of the well bore, resistivity of the formation, dielectric constant, neutron porosity, rock neutron density, permeability, acoustic velocity, natural gamma ray, formation pressure, fluid mobility, fluid composition, rock matrix composition, magnetic resonance imaging of formation fluids, rock sonic strength and gravimeters.

Optionally, the tool has a sensor for detecting an operational condition of the tool. An embodiment of the tool includes a fluid flow sensor in the internal fluid conduit downstring of the booster fluid pump. Such a sensor positioned downstring of the booster fluid pump can detect the total fluid flow rate and, depending on the configuration of the sensor, the direction of flow through the internal fluid conduit. Determining the total fluid flow rate traversing through the internal fluid conduit is useful for monitoring tool operations, including inflation and deflation of the packers, the application of treatment fluid into the isolated well bore volume, and determining the flow back from the isolated well bore volume. Such a sensor may also be useful for detecting a wellbore condition, including an increase in flow back that may indicate an unstable well bore condition within the isolated well bore volume. Other sensors are useful for detecting the operational condition of the tool, including fluid pressure, fluid differential pressure, fluid temperature, gas content, pH, density, viscosity, solids content, motor temperature, stress load, string stress, internal and external hydraulic fluid pressures, torque and tension/compression, string strain, inclinometers, magnetometers, accelerometers, bending, and vibration. Those of ordinary skill in the art understand that many of the downhole and operational conditions given do overlap and therefore are only illustrative. Other detectable wellbore and tool operational condition not included are not excluded as useful conditions for monitoring.

In an embodiment of the tool, the ECP is operable to receive from the sensor and then convey uphole to the surface the associated signal. In such an embodiment, the ECP is operable to receive from the sensor the signal associated with the detected condition and then retransmit the received signal uphole. In such an embodiment, the ECP acts as a communications sub in that it relays the signal provided by the sensor and routes the signal uphole for use, including interpretation and action by operators and control systems present on the surface. In an embodiment of the tool, the ECP is operable to boost the strength of the signal retransmitted uphole. Increasing power to the associated signal can improve the likelihood that the signal does not degrade such that it is not interpretable when received at the surface. The retransmission may occur using wireline, drill pipe, intelligent pipe or wireless transmission communications systems as determined suitable by one of ordinary skill in the art.

In an embodiment tool, the ECP is operable to receive a command signal from the surface and then relay the command signal to a subsystem of the tool that is operable to receive such a command signal. Upon receipt of a command signal, the tool is operable to perform a function associated with the command signal. In such an embodiment, the ECP acts as a communications sub and is operable to interpret the command signal such that the signal is routed to the appropriate subsystem of the tool. For example, a command signal may be associated with changing the direction of spin of the reversible motor. The ECP, upon receipt of such a command signal, routes the signal to the reversible motor. The reversible motor is operable to interpret the signal and modify its operation accordingly to comply with the command signal In an embodiment of the tool, the ECP is operable to receive a command signal, to interpret the command signal using a pre-determined instructions, and to distribute an operational signal to the appropriate subsystem, where the operational signal is determined based upon the pre-determined instructions associated with the command signal, such that the tool is operable to perform a function associated with the command signal. In such an embodiment, the ECP is operable to interpret the command signal using a set of pre-determined instructions accessible to the ECP and provide an associated operational signal to the appropriate subsystem of the tool to perform a function associated with the command signal. In such an embodiment, the ECP has an on-board computer that has a microprocessor for interpreting the pre-determined instructions and the command signal and memory for maintaining accessibility of the microprocessor to the pre-determined instructions. Using the pre-determined instructions and the command signal, the ECP is also operable to permit selective distribution of electrical power to the appropriate subsystem. Supplying or restricting electrical power may cause the tool to perform the function associated with the command signal. In such an embodiment of the tool, a command signal associated with changing the direction of spin of the reversible motor received by the ECP causes the ECP to access pre-determined instructions regarding modifying the operational condition of the reversible motor. Such instructions may include steps for the ECP such that the ECP reduces the power transmitted to the reversible motor for a period to allow the pump to slow its rotation under fluid friction, transmits an operational signal to the reversible motor associated with modifying direction of motor spin, and provides power to the reversible motor in a gradual manner over a period such that the motor rotates in the opposing direction.

In an embodiment of the tool, the ECP is operable to receive a signal associated with a detected wellbore condition or a tool operational condition, to interpret the received signal using pre-determined instructions, and to distribute operational signals based upon the pre-determined instructions associated with the detected condition to subsystems such that the tool performs actions in response to the detected condition. Such an embodiment permits automated, localized control of the tool in response to detected tool or wellbore conditions based upon pre-determined instructions, which can include operational and condition set point values and tolerances away from the operational and condition set point values. In such an embodiment of the tool, the sensor detects a condition and transmits the associated signal to the ECP. The ECP, upon receipt of the associated signal, accesses pre-determined instructions associated with the detected condition to determine if the detected condition is outside of the permitted tolerance for the condition and a modification to the operation of the tool is needed. If the determination indicates that a change in tool operations is required, the ECP conveys to the appropriate subsystem an operational signal associated with modifying the operation of the tool such that the detected condition is modified such that it is within the pre-determined tolerance. The modified operation of the tool is such that the tool or wellbore condition approaches the tolerance of the operational and condition set point value. Such an embodiment permits on-the-fly modification to operations of the tool based on real-time assessment of pre-determined treatment profiles without the necessity of significant operator interference. The ECP, upon receiving an associated signal from a sensor indicating that the detected condition is within a given tolerance of the operational and condition set point value, may send an operational signal to the appropriate subsystem to modify the operation of the tool back to its original status.

FIG. 2

FIG. 2 shows an embodiment of the method of using an embodiment of the zonal isolation and treatment tool for introducing a treatment fluid to a stratum to be treated. Treatment fluids useful for applying to a targeted stratum include matrix acidizing, acid or pressure fracking, acid wellbore treatment, proppant introduction, polymer water shut-off, chemical diversion, foam, and water conformance fluids.

Figure 2A:
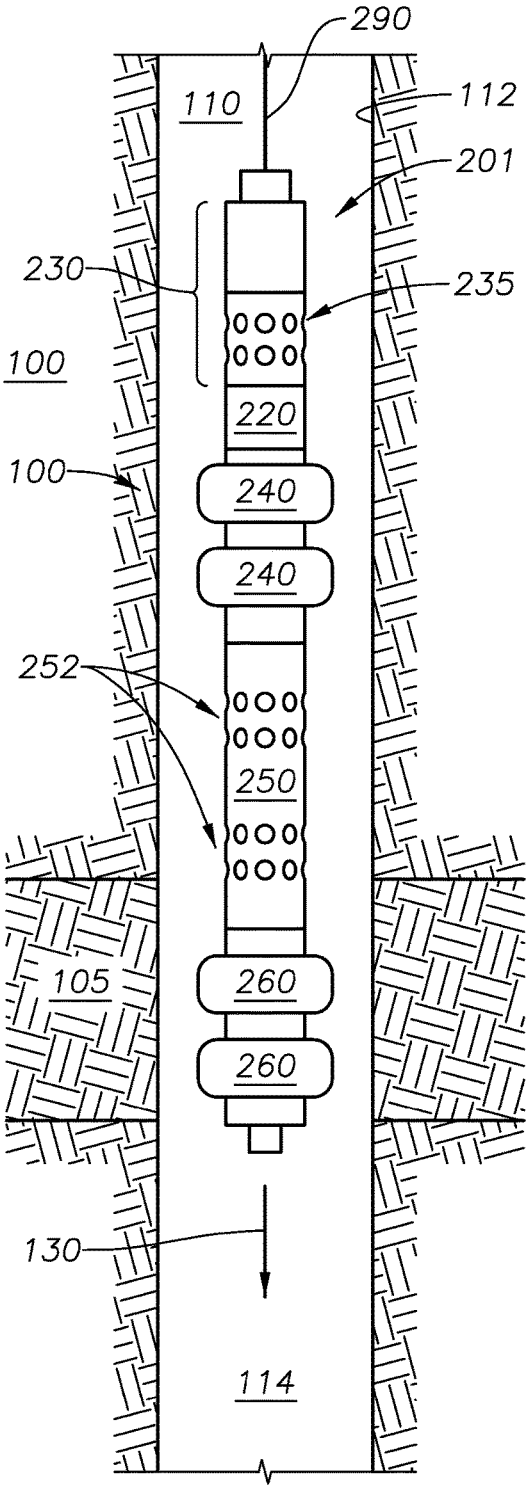
FIGS. 2A-2G are a schematic of an embodiment of the method of using an embodiment of the tool for introducing a treatment fluid to a stratum to be treated.

As shown in FIG. 2A, formation 100 contains stratum to be treated 105 (also known as "targeted stratum"). Well bore 110 traverses through formation 100, including at least a portion of the targeted stratum 105, and is defined by well bore wall 112. Well bore 110 is filled with well bore fluid 114 to maintain support for targeted stratum 105 and other non-clad or otherwise supported portions of formation 100 contacting well bore 100.

Introduced into well bore 110 in downhole direction (arrow 130) and positioned proximate to targeted stratum 105 is zonal isolation and treatment tool 201. The embodiment of the tool of FIG. 2A includes reversible fluid booster pump 230 with pump fluid access port 235, electronics control package 220, several upper isolation packers 240, treatment fluid distributor 250 with treatment fluid port 252, and several lower isolation packers 260.

Figure 2B:
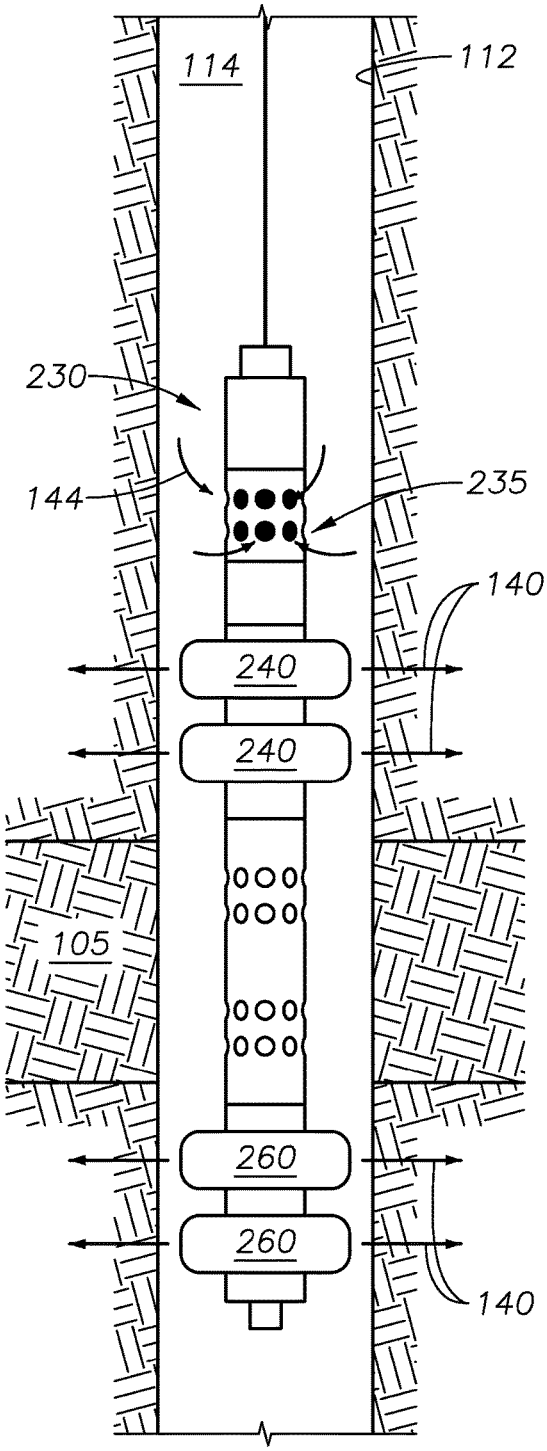

FIG. 2B shows zonal isolation and treatment tool 201 positioned straddling targeted stratum 105 between upper isolation packers 240 and lower isolation packers 260. Electronics control package 220 has manipulated tool 201 such that pump fluid access port 235 are open (black circles), reversible fluid booster pump 230 operates to draw well bore fluid 114 though pump fluid access port 235 (curved arrows 144), and both upper and lower isolation packers 240, 260 expand (arrows 140) towards well bore wall 112.

Well bore fluid that is drawn into the tool is pumped through the tool internal fluid conduit into each isolation packer. The ECP selectively permits fluid to flow through the tool internal fluid conduit and isolation valves such that the drawn in and pressurized well bore fluid enters each isolation packer, inflating the packers. The packers may be inflated sequentially, in pairs, or simultaneously. In response to the increasing amount of well bore fluid in the internal part of each isolation packer, the elastic surface for the packer expands outward until it meets a surface that resists further expansion, which is typically the well bore wall or casing of the well bore.

Figure 2C:
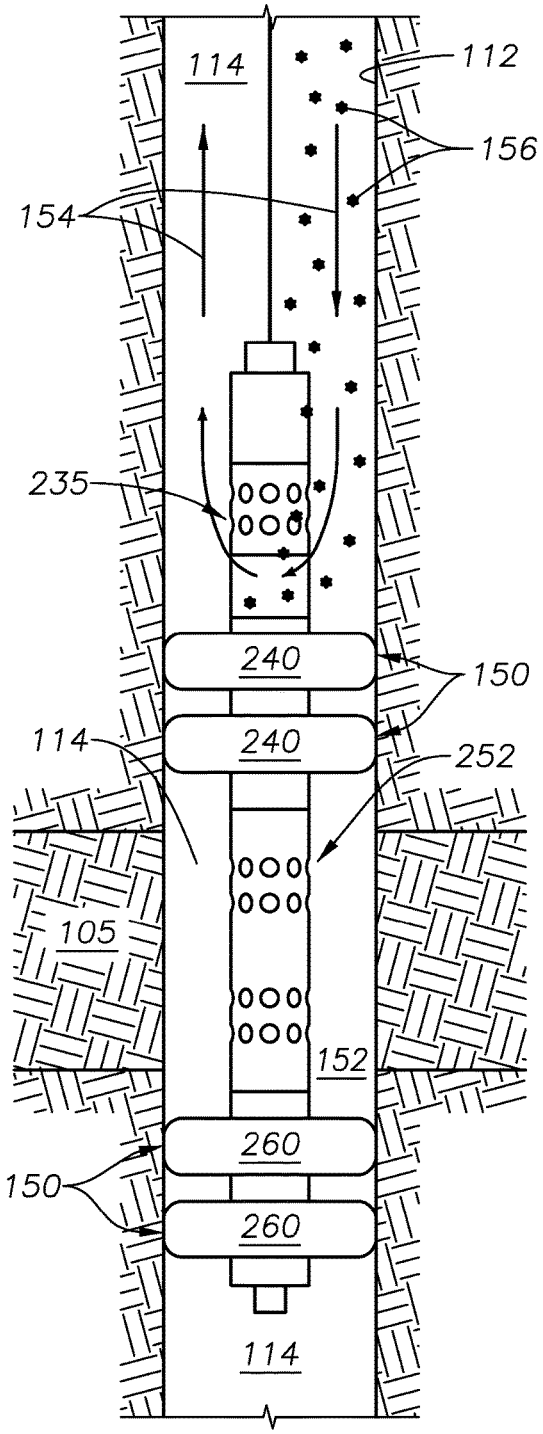

FIG. 2C shows zonal isolation and treatment tool 201 having formed seals 150 against well bore wall 112 using both upper and lower isolation packers 240, 260. The formation of seals 150 also forms isolated well bore volume 152. Isolated well bore volume 152 is a portion of well bore 110 that is fluidly isolated from the remainder of well bore 110. Isolated well bore volume 152 is fluidly isolated from the remainder of well bore except through tool 201. Tool 201 permits selective fluid communication between isolated well bore volume 152 and the remainder of well bore 110. As shown in FIG. 2C, the status of tool 201 indicates that no fluid communication between isolated well bore volume 152 and the remainder of well bore 110 occurs as both pump fluid access port 235 and treatment fluid port 252 are closed (white circles).

Isolated well bore volume 152 is in fluid communication with targeted stratum 105 through a segment of well bore wall 112 located between upper and lower isolation packers 240, 260. Tool 201 is shown in FIG. 2C as completely enveloping the portion of well bore wall 112 that acts as the fluid interface between targeted stratum 105 and isolated well bore volume 152. In an embodiment of the method, the tool is positioned within the well bore such that a portion of the well bore wall in fluid communication with the targeted stratum is located between the upper and lower isolation packers of the tool. There are instances where the tool may not have the length to fully isolated the targeted stratum, especially instances where the tool is maneuvered through a horizontal, multi-lateral or multi-tiered well system. In such methods, the tool is positioned in a first location for treating a portion of the targeted stratum, treatment is applied, and the tool is positioned in a second location for treating a different portion of the same targeted stratum, and a second treatment is applied. The process can be repeated for as many times as necessary to effectively apply the treatment chemical to the targeted stratum. Such a procedure is useful for handling very thick hydrocarbon-bearing stratum.

FIG. 2C also shows treatment fluid 156 being circulated from the surface (arrows 154) downhole to zonal isolation and treatment tool 201. The treatment chemical may be delivered proximately to the tool by "bullheading" the treatment fluid directly from the wellhead using low-pressure well bore fluid circulation pumps at the surface, by coiled tubing inserted into the well bore at least part of the way downhole towards the tool or by a drill pipe coupled with units on the surface and circulating the treatment fluid downhole. Regardless of the means of delivering the treatment fluid downhole, treatment fluid 156 aggregates around pump fluid access port 235 in preparation for treating targeted stratum 105.

Figure 2D:
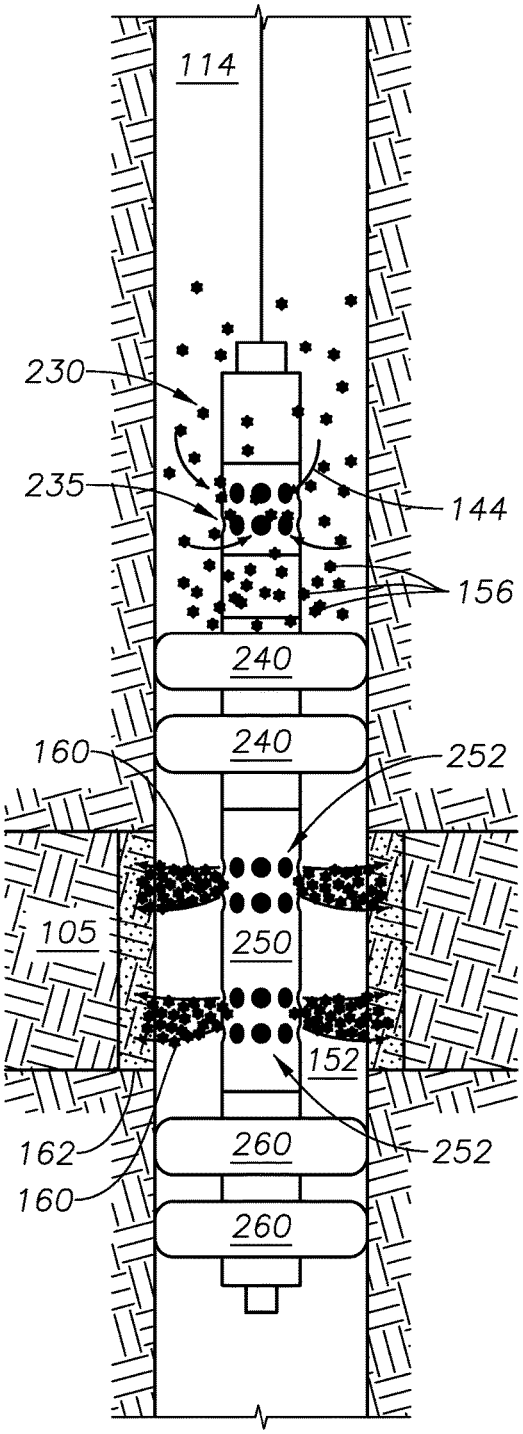

FIG. 2D shows that electronics control package 220 has manipulated zonal isolation and treatment tool 201 such that both pump fluid access port 235 and treatment fluid port 252 are open (black circles), reversible fluid booster pump 230 operates to draw into tool 201 well bore fluid 114 containing treatment fluid 156 though pump fluid access port 235 (curved arrows 144), and introducing well bore fluid 114 containing treatment fluid 156 into isolated well bore volume 152. The introduction of the treatment fluid is shown in FIG. 2C such that treatment fluid 156 is jetted (arrows 160) from open treatment fluid port 252 onto well bore wall 112 of targeted stratum 105 such that the treatment fluid and the stratum to be treated interact with each other and form a layer of treated stratum 162.

As the introduction of treatment fluid and well bore fluid into the isolated well bore volume continues via the zonal isolation and treatment tool, the fluid pressure within the isolated well bore volume increases. The pressure increases until either the tool restricts or stops introducing fluid into the isolated well bore volume or the fluid within the isolated well bore volume flows into the targeted stratum. In an embodiment of the method, the fluid pressure within the isolated well bore volume is maintained at a pressure less than the pore pressure of the stratum to be treated. Maintaining the fluid pressure within the isolated well bore volume at this less-than-pore-pressure value permits the interface of the formation—the well bore wall surface—to be treated with the chemical treatment without penetrating much further into the now-treated stratum. In an embodiment of the method, the fluid pressure within the isolated well bore volume is maintained at a pressure greater than the pore pressure but less than the fracture pressure of the stratum to be treated. Maintaining the fluid pressure within the isolated well bore volume at this fluid pressure permits the treatment fluid to slowly push into the targeted stratum using differential pressure and capillary effects. This prevents any undesirable physical damage to the interface of the now-treated stratum. In an embodiment of the method, the fluid pressure within the isolated well bore volume is maintained at a pressure greater than the fracture pressure of the stratum to be treated. Maintaining the fluid pressure at an elevated state relative to the fracture pressure of the stratum to be treated will eventually cause targeted stratum to fracture, allowing the treatment fluid to drive into the fracture channels preferentially over the pressure differential distribution of the treatment fluid. Pumping fluid into the isolated portion of the well bore at this pressure is useful for deep penetration of both acids and proppants.

In an embodiment of the method, the volume and pressure used to introduce the treatment fluid can abrade the well bore wall interface of the targeted stratum. In such an embodiment, the jetting effect caused by the introduction of the treatment fluid through the treatment fluid port can physically disrupt the surface of the well bore wall of the targeted stratum, including fluidly blasting off scale, mud, salts and chemically inactivated formation rock to expose a fresh formation surface for chemical treatment, regardless of the specific treatment fluid used. In an embodiment of the method, the volume rate of introduction of treatment fluid into the isolated well bore volume is in a range of from about 10 gallons to about 100 gallons per minute as measured at standard conditions.

Figure 2E:
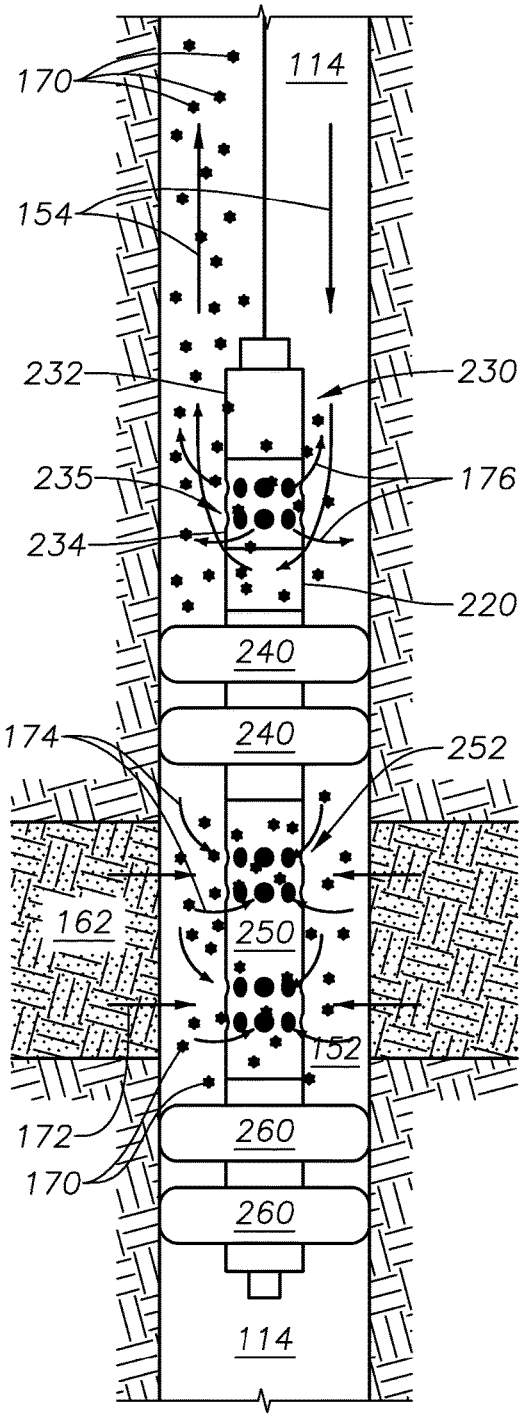

FIG. 2E shows aspects of the post-treatment status of the zonal isolation and treatment tool 201, formation 100 and well bore 110. As previously seen in FIG. 2D, treatment fluid 156 introduced into isolated well bore volume 152 was exposed to targeted stratum 105. During exposure of the treatment fluid and the targeted stratum, an interaction between the two occurs. Treatment fluid 156 is converted into spent treatment fluid 170, and the stratum to be treated is converted into treated stratum 162.

In addition to the changes in the stratum and the treatment fluid, FIG. 2E shows that electronics control package 220 has manipulated zonal isolation and treatment tool 201 to perform treatment site clean-up and potential kick-off tasks. The rotation of reversible motor 232 has been reversed compared to FIGS. 2B and 2D such that booster fluid pump 234 operates to draw into tool 201 through open treatment fluid port 252 (arrows 174) spent treatment fluid 170 from not only isolated well bore volume 152 but also from within treated stratum 162 (arrows 172). The fluids drawn into tool 201 are passed into well bore 110 though open pump fluid access port 235 (curved arrows 176).

FIG. 2E also shows spent treatment fluid 170 being circulated to the surface (arrows 154) uphole from zonal isolation and treatment tool 201. The spent treatment chemical may be removed from the tool using similar "bullheading", coiled tubing or drill pipe similar to the means for delivering the treatment fluid downhole. The circulation of well bore fluid is sufficient to carry the spent treatment fluid from the tool and towards the surface.

In an embodiment of the method, the drawing of fluid by zonal isolation and treatment tool from the treated stratum while maintaining the isolated well bore volume similar to that shown in FIG. 2E can be enough in fluid volume such that a pressure differential forms and hydrocarbon-bearing fluids or formation waters such as brines, or both, are produced from the treated stratum in measurable quantities. With production of hydrocarbon-bearing fluid, the tool acts as a submersible pumping system that draws in the hydrocarbon-bearing fluids, boosts the pressure of the fluid, and discharges the pressurized fluid into the well bore uphole from the tool such that it is motivated to flow uphole towards the surface. Using such a technique, the tool can provide flow stimulation for volumes of hydrocarbon-bearing fluid in a range of from about 100 barrels per day to about 10,000 barrels per day from the treated stratum.

Figure 2F:
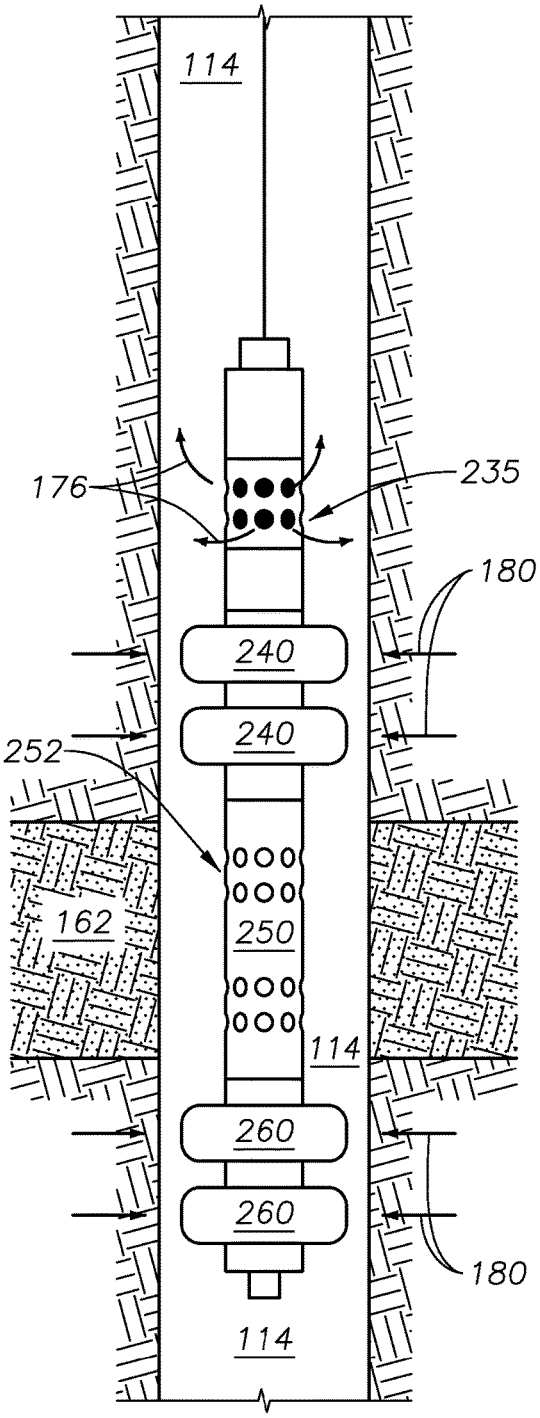

FIG. 2F shows that electronics control package 220 has manipulated tool 201 such that pump fluid access port 235 are open (black circles), treatment fluid port 252 are closed (white circles), reversible fluid booster pump 230 operates to purge from tool 201 the fluid that was contained in both upper isolation packers 240 and lower isolation packers 260 though pump fluid access port 235 (curved arrows 176). Both upper isolation packers 240 and lower isolation packers 260 deflate (arrows 180) as reversible fluid booster pump 230 draws fluid from them. The retreat of upper isolation packers 240 and lower isolation packers 260 from well bore wall 112 eliminates fluid seals 150 and isolated well bore volume 152, allowing well bore fluid 114 from downhole of lower isolation packers 260 and from uphole of upper isolation packers 240 to flow into the volume of well bore 110 that use to include isolated well bore volume 152.

Figure 2G:
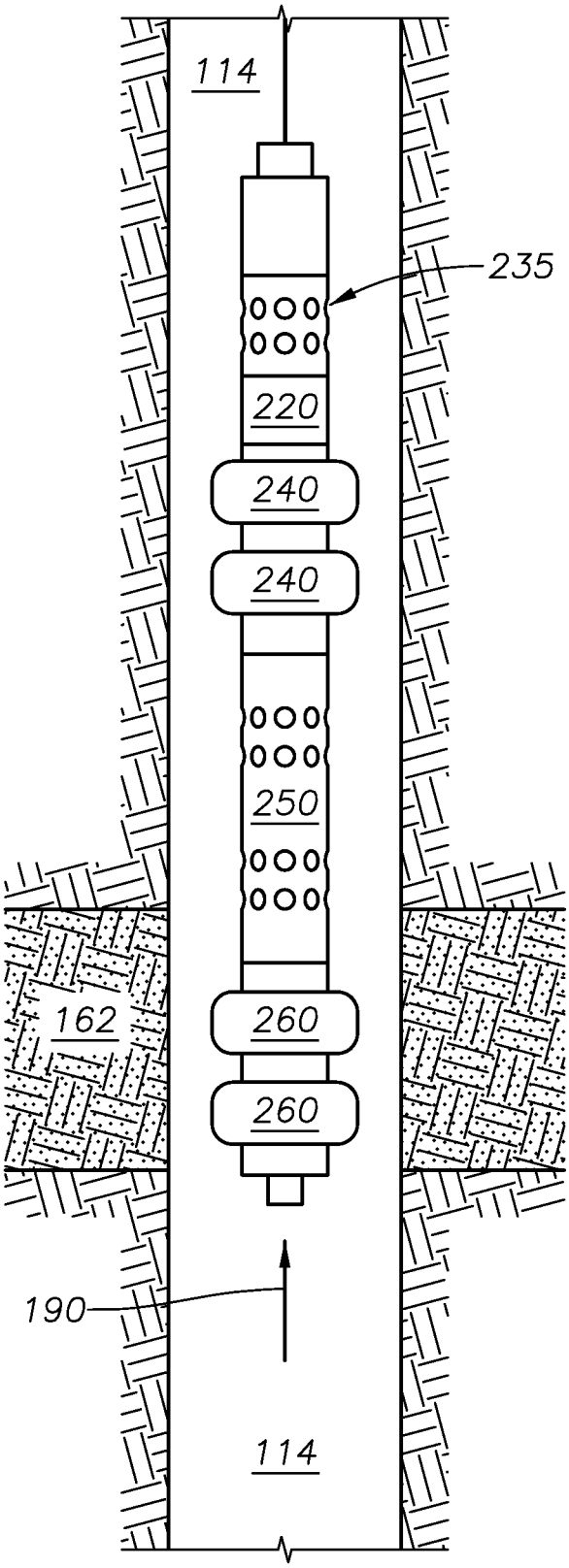

FIG. 2G shows the embodiment of the zonal isolation and treatment tool 201 being repositioned away from the treated stratum 162. Pump fluid access port 235 are closed (white circles), upper isolation packers 240 and lower isolation packers 260 are fully deflated, and tool 201 is being positioned (arrow 190) either uphole of treated stratum 162 or is being removed from well bore 110.

Supporting Equipment

An embodiment of the zonal isolation and treatment tool or its method of use includes many additional standard components or equipment that enables and makes operable the described apparatus, process, method and system. Examples of such standard equipment known to one of ordinary skill in the art may include heat exchanges, pumps, blowers, reboilers, steam generation, condensate handling, membranes, single and multi-stage compressors, separation and fractionation equipment, valves, switches, controllers and pressure-, temperature-, level- and flow-sensing devices.

Operation, control and performance of portions of or entire steps of a process or method can occur through human interaction, pre-programmed computer control and response systems, or a combination thereof.

What is claimed is:

1. A method of using a zonal isolation and treatment tool for introducing a treatment fluid to a targeted stratum within a formation such that the targeted stratum is converted to a treated stratum, the method comprising the steps of:

introducing the tool into a well bore such that the targeted stratum is positioned between an upper isolation packer and a lower isolation packer of the tool, where the well bore is defined by a well bore wall, where the well bore traverses the formation from a surface downwards to at least the targeted stratum, where the well bore is filled with a well bore fluid, and where both the upper and lower isolation packers are each operable to fluidly seal against the well bore wall upon inflation;

operating the tool such that a reversible fluid booster pump of the tool draws the well bore fluid into the tool and each of the upper and lower isolation packers are inflated with the well bore fluid such that both the upper and lower isolation packer seal fluidly against the well bore wall, where the upper isolation packer seals uphole of the targeted stratum and the lower isolation packer seals downhole of the targeted stratum such that an isolated well bore volume forms between the upper isolation packer and the lower isolation packer, where the isolated well bore volume is selectively fluidly accessible to a remainder of the well bore through a treatment fluid distributor of the tool, where at least a portion of the well bore wall associated with the targeted stratum is located between the upper and lower isolation packers, where the portion of the well bore wall associated with the targeted stratum is operable to provide fluid communication between the isolated well bore volume and the targeted stratum, where the tool includes the reversible fluid booster pump that is operable to draw the well bore fluid into the tool through a pump fluid access port, and where the tool includes the treatment fluid distributor that is operable to provide selective fluid access between the isolated well bore volume and the remainder of the well bore;

introducing the treatment fluid from the surface into the well bore such that the treatment fluid is positioned within an annular space defined between the well bore wall and the tool proximate to the pump fluid access port of the tool;

operating the tool such that the reversible fluid booster pump draws the treatment fluid into the tool from the well bore through the pump fluid access port and that the treatment fluid distributor discharges the treatment fluid from the tool out through a treatment fluid port and into the isolated well bore volume; and maintaining the isolated well bore volume such that the treatment fluid interacts with the targeted stratum through the portion of the well bore wall associated with the targeted stratum, where the treatment fluid forms a spent treatment fluid and the targeted stratum forms the treated stratum upon interaction with one other.

2. The method of claim 1 further comprising the steps of operating the tool such that the spent treatment fluid is drawn into the treatment fluid distributor through the treatment fluid port and the reversible fluid booster pump discharges the spent treatment fluid from the tool through the pump fluid access port into the remainder of the well bore, and circulating the well bore fluid down the well bore to carry the spent treatment fluid towards the surface.

3. The method of claim 2 where the tool is operated such that that the spent treatment fluid is drawn into the treatment fluid distributor through the treatment fluid port from the isolated well bore volume at a volumetric flow rate in a range of from about 10 gallons per minute to about 100 gallons per minute.

4. The method of claim 1 further comprising the step of removing the spent treatment fluid from the well bore.

5. The method of claim 1 further comprising the step of operating the tool such that the upper and lower isolation packers are not operable to fluidly seal against the well bore wall and such that the isolated well bore volume is not fluidly isolated from the remainder of the well bore, where the well bore fluid within the upper and lower isolation packers is discharged through the pump fluid access port of the reversible fluid booster pump.

6. The method of claim 1 where the treatment fluid is selected from the group consisting of matrix acidizing fluids, acid or pressure fracking fluids, acidic wellbore treatment fluids, fluids with proppants, polymer water shut-off fluids, chemical diversion fluids and gels, di-phase fluids for enhanced oil recovery, tri-phase fluids for enhanced oil recovery, foams, surfactant solutions, mud and scale removal treatment fluids, relativity permeability modifiers fluids, and water conformance fluids.

7. The method of claim 1 where introducing the treatment fluid into the well bore is performed by bullheading the treatment fluid into the well bore.

8. The method of claim 1 where the tool is operated such that the treatment fluid distributor discharges the treatment fluid into the isolated well bore volume at a volumetric flow rate of from about 10 gallons per minute to about 100 gallons per minute.

9. The method of claim 1 where the tool is operated such that the treatment fluid distributor discharges the treatment fluid into the isolated well bore volume at a volumetric flow rate such that the portion of the well bore wall associated with the targeted stratum becomes abraded.

10. The method of claim 1 where the isolated well bore volume is maintained such that a fluid pressure within the isolated well bore volume is at a pressure less than about a pore pressure of the targeted stratum.

11. The method of claim 1 where the isolated well bore volume is maintained such that a fluid pressure within the isolated well bore volume is at a pressure greater than about a pore pressure and less than about a fracture pressure of the targeted stratum.

12. The method of claim 1 where the isolated well bore volume is maintained such that a fluid pressure within the isolated well bore volume is at a pressure greater than a fracture pressure of the targeted stratum.

13. The method of claim 1 further comprising the step of operating the zonal isolation and treatment tool such that a hydrocarbon-bearing fluid is drawn into the treatment fluid distributor through the treatment fluid port and the reversible fluid booster pump discharges the hydrocarbon-bearing fluid from the tool through the pump fluid access port into the well bore.

14. The method of claim 13 where the hydrocarbon-bearing fluid is drawn into the treatment fluid distributor at a volumetric flow rate of from about 100 barrels per day to about 10,000 barrels per day.

15. A zonal isolation and treatment tool comprising:

a reversible fluid booster pump having a reversible motor mechanically coupled to a booster pump, where the reversible fluid booster pump has a plurality of pump fluid access ports spaced circumferentially around an outer diameter of the reversible fluid booster pump that are operable to provide selective fluid access from an annular space defined between the well bore wall and the tool above an upper isolation packer through the booster pump and where the booster pump is coupled to an internal fluid conduit located within the tool;

the upper isolation packer and a lower isolation packer, each having an elastic surface that is operable to fluidly seal against another surface when inflated, each being selectively fluidly coupled through the internal fluid conduit with the booster pump;

a treatment fluid distributor that is located upstring of the lower isolation packer and downstring of the upper isolation packer, has a plurality of treatment fluid ports spaced circumferentially around an outer diameter of the treatment fluid distributor that are operable to provide selective fluid access to the internal fluid conduit, and are selectively fluidly coupled through the internal fluid conduit with the booster pump; and an electronics control package that is electrically coupled to the reversible motor and is operable to maintain selectively both spin direction and spin rate of the reversible motor of the reversible fluid booster pump.

16. The tool of claim 15 where a volumetric pumping rate for the reversible fluid booster pump is in a range of from about 10 gallons per minute to about 100 gallons per minute.

17. The tool of claim 15 where a volumetric pumping rate for the reversible fluid booster pump is in a range of from about 100 barrels to about 10,000 barrels of hydrocarbon-bearing fluid per day.

18. The tool of claim 15 where the electronics control package is electrically coupled to the treatment fluid distributor such that the electronics control package is operable to maintain the selective fluid access to the internal fluid conduit through the treatment fluid ports.

19. The tool of claim 15 where the electronics control package is electrically coupled to the treatment fluid distributor such that the electronics control package is operable to maintain the selective fluid access of the treatment fluid distributor to the booster pump.

20. The tool of claim 15 further comprising a sensor, where the sensor is signally coupled to the electronics control package and is operable to both detect a wellbore condition within the isolated well bore volume and send an associated signal related to the detected wellbore condition to the electronics control package.

21. The tool of claim 20 where the electronics control package is operable to modify operation of the tool based upon the associated signal related to the detected wellbore condition automatically based upon pre-determined instructions.

* * * * *